United States Patent [19]

Kobayashi et al.

[11] Patent Number: 4,792,296

[45] Date of Patent: Dec. 20, 1988

[54] SCROLL COMPRESSOR WITH PRESSURE-EQUALIZING PASSAGE AND GAS VENT CONDUIT IN MAIN SHAFT

[75] Inventors: Norihide Kobayashi; Tadashi Kimura; Tsutomu Inaba; Masahiro Sugihara, all of Wakayama, Japan

[73] Assignee: Mitsubishi Denki Kabushiki Kaisha, Tokyo, Japan

[21] Appl. No.: 110,273

[22] Filed: Oct. 20, 1987

[30] Foreign Application Priority Data

Oct. 27, 1986 [JP] Japan ..... 61-256404

[51] Int. Cl.[4] ..... F04C 18/04; F04C 29/02

[52] U.S. Cl. ..... 418/55; 418/88; 418/94; 184/6.23

[58] Field of Search ..... 418/55, 88, 94; 184/6.18, 6.23

[56] References Cited

U.S. PATENT DOCUMENTS

| | | | |
|---|---|---|---|
| 4,065,279 | 12/1977 | McCullough | 418/55 |
| 4,343,599 | 8/1982 | Kousokabe | 418/55 |
| 4,488,855 | 12/1984 | Butterworth et al. | 418/55 |
| 4,623,306 | 11/1986 | Nakamura et al. | 418/94 |

FOREIGN PATENT DOCUMENTS

| | | | |
|---|---|---|---|
| 59-32691 | 2/1984 | Japan | 418/94 |

*Primary Examiner*—John J. Vrablik

*Attorney, Agent, or Firm*—Oblon, Fisher, Spivak, McClelland, & Maier

[57] ABSTRACT

A scroll compressor is provided with a main shaft to drive an orbiting scroll whereby fluid in a compression chamber which is formed by combining a stationary scroll with the orbiting scroll is compressed and then is discharged from the scroll compressor. To prevent a refrigerant gas in an eccetric recess formed in the main shaft from mixing with a lubricating oil, a conduit is formed in the main shaft to communicate the eccentric recess with a space between the lower part of the orbiting scroll and the upper part of the main shaft.

6 Claims, 3 Drawing Sheets

SCROLL COMPRESSOR WITH PRESSURE-EQUALIZING PASSAGE AND GAS VENT CONDUIT IN MAIN SHAFT

BACKGROUND OF THE INVENTION

1. Field of the Invention

The present invention relates to a scroll compressor used for an apparatus such as a refrigerator, an air conditioner and so on in which a refrigerant is compressed.

2. Discussion of Background

Before discussing the present invention, the principle of the scroll type fluid transferring machine will be briefly described.

FIG. 2 shows the major structural elements and the principle of compression when a scroll type fluid transferring machine is used as a compressor.

In FIG. 2, a reference numeral 1 designates a stationary scroll, a numeral 2 designates an orbiting scroll, a numeral 3 designates an intake chamber, a numeral 4 designates a discharge port and a numeral 5 designates a compression chamber. A symbol O represents the center of the stationary scroll 1.

The stationary and orbiting scrolls 1, 2 respectively have a wrap plate 1*a* or 2*a*. The wrap plates 1*a*, 2*a* have the same shape but the winding direction of the wrap plates is opposite. They are constituted by involute curves or a combination of curved lines.

The operation of the scroll type fluid trasferring machine will be described. The stationary scroll 1 stands still in space, and the orbiting scroll 2 is combined with the stationary scroll 1 with a phase deviated from 180° so that the orbiting scroll 2 undergoes the movement of revolution but not rotation around the center of the stationary scroll 1. FIGS. 2*a* to 2*d* show each state of the stationary and orbiting scrolls 1, 2 at angle positions of 0°, 90°, 180° and 270°. FIG. 2*a* shows the state of the angle position of 0° at which enclosure of a fluid in the intake chamber 3 is finished and the compression chamber 5 is formed between the wrap plates 1*a*, 2*a*. As the orbiting scroll 2 rotates, the volume of the compression chamber 5 gradually decreases to compress the fluid, and finally the compressed fluid is discharged through the discharge port 4 formed at the center of the stationary scroll 1.

In the next place, the construction and the operation of the scroll compressor will be described. FIG. 3 shows a typical construction of the scroll compressor as disclosed, for instance, in Japanese Patent Application No. 64571/1984, in which the scroll compressor is used for a totally closed type refrigerant compressor.

In FIG. 3, the wrap plate la of the stationary scroll 1 is formed on a surface of the base plate 1*b*. The orbiting scroll 2 comprises the wrap plate 2*a* formed on a surface of the base plate 2*b* and a scroll shaft 2*c* formed on the other surface of the base plate 2*b*. The intake chamber (intake port) 3 and the compression chamber 5 are formed by combining the wrap plates 1*a*, 2*a* of the stationary and orbiting scrolls 1, 2 as described above.

A reference numeral 6 designates a main shaft, a numeral 7 designates an oil cap having an intake port 7*a* which is attached to the lower portion of the main shaft 6 so as to cover the lower portion with a predetermined space, numerals 8, 9 designate bearing supporters, a numeral 10 designates the rotor of an electric motor, a numeral 11 designates the stator of the motor, a numeral 12 designates a shell containing the structural elements of the scroll compressor, a numeral 13 designates an Oldham coupling, a numeral 14 designates an obstacle plate, a numeral 15 designates an oil reservoir formed in the bottom of the shell. A fluid intake pipe 16 and a discharge pipe 17 are respectively mounted on the shell 12 so as to pass through it.

The main shaft 6 has an enlarged diameter portion 6*a* at its upper part in which an eccentric cylindrical recess 6*d* is formed in the upper surface of the large diameter portion at a position deviated from the axial center of the main shaft. The scroll shaft 2*c* of the orbiting scroll 2 is received in the eccentric recess 6*d*. An orbiting scroll bearing 18 is fitted between the outer circumferential surface of the scroll shaft 2*c* and the inner surface of the eccentric recess 6*d* in a freely rotatable manner. A space 6*e* is formed between the lower end of the scroll shaft 2*c* and the bottom of the eccentric recess 6*d*. A first main bearing 19 is placed on the outer circumferential surface of the large diameter portion 6*a* of the main shaft 6 to rotatably support the main shaft 6. A second main bearing 20 supports a small diameter portion 6*b* at the lower part of the main shaft 6. A thrust bearing 21 supports the lower surface of the base plate 2*b* as a sliding surface 2*d* of the orbiting scroll 2 in the axial direction. A second thrust bearing 22 supports a step portion 6*c* formed at the boundary between the large diameter portion 6*a* and the small diameter portion 6*b* of the main shaft 6 in the axial direction. An oil feeding passage 23 extends in the main shaft 6 at a position deviated from the axial center so as to communicated with each of the bearings 18 to 20. In FIG. 3, a reference numeral 24 designates a gas-vent hole formed in he main shaft 6, numerals 25, 26 designate oil returning openings and numerals 27, 28 designate communicating openings which allow the intake gas to pass therethrough.

In the conventional scroll compressor, the orbiting scroll 2 is combined with the stationary scroll 1; the scroll shaft 2*c* is engaged with the main shaft 6 by means of the scroll bearing 18, and the orbiting scroll 2 is supported by the main shaft 6 through the scroll bearing 18 and the first thrust bearing 21 mounted on the bearing supporter 8.

The main shaft 6 is supported in the shell 12 by means of the first main bearing 19 provided in the bearing supporters 8, 9, the second main bearing 20 and the second thrust bearing 22. The Oldham coupling 13 is provided between the orbiting scroll 2 and the bearing supporter 8 to prevent the orbiting scroll 2 to rotate around its axial center but to allow it to have only a movement of revolution. After the above-mentioned elements are preliminarily assembled, the stationary scroll 1 is fastened to the bearing supporters 8, 9 by means of bolts. The rotor 10 is fixed to the main shaft and the stator 11 is fixed to the bearing supporter 9 by forcibly inserting, stake-fitting or screwing. The oil cap 7 is fixed to the main shaft 6 by the forcibly inserting or stake-fitting. The assembled elements are together received in and fixed to the interior of the shell 12 with the stationary and orbiting scrolls 1, 2 directing upward while the rotor 10 and the stator 11 located downward. The entire assembly is fixed to the shell by the forcible-insertion or the stake-fitting.

The operation of the conventional scroll compressor having the construction as mentioned above will be described.

On starting actuation of the rotor 10 of the motor, the revolution of the orbiting scroll 2 is initiated by means of the main shaft 6 and the Oldham coupling 1, whereby compression of the gas is initiated by the principle of operation as described with reference to FIG. 2. The refrigerant gas is sucked into the shell 12 through the intake pipe 16. The gas is passed through the communicating opening 27 formed between the bearing supporter 9 and the stator 11 of the motor, and the air gap formed between the rotor 10 and the stator 11 as indicated by solid lines, while the refrigerant gas cools the motor. Then, the gas is passed through the communicating opening 28 formed bewtween the shell 12 and the bearing supporters 8, 9, and is taken into the compression chamber 5 through the intake port 3 formed in the stationary scroll 1 so as to be compressed. The compressed gas is discharged outside the compressor via the discharge port 4 and the discharge pipe 17.

The lubricating oil is sucked into the oil feeding passage 23 by the action of centrifugal pumping function which is given by the oil cap and the oil feeding passage 23 formed in the main shaft 6. The lubricating oil is fed through the oil feeding passage 23 from the intake port **7*a* of the oil cap 7 to the space 6*e* in the eccentric recess 6*d* from which the lubricating oil is supplied to each of the bearings 18, 20 and then, is supplied to the bearings 21, 19, 22 in this order, as indicated by broken arrow marks. After lubrication to the bearings, the lubricating oil is returned to the oil reservoir 15 after it is mainly passed through the oil returning openings 25, 26 which are respectively formed in the bearing supporters 8, 9. The obstacle plate 14 is provided to close an air gap between the bearing supporter 8 and the outer circumferential surface of the orbiting scroll 2 so that a part of the lubricating oil leaked from the bearing 21 is not directly sucked into the intake port 3 (intake chamber). The obstacle plate 14 separates the intake port 3 (intake chamber) from the movable parts of the compressor in association with the orbiting scroll 2. The gas-vent hole 24 formed in the main shaft 6 has such function that gas in the oil cap 7** is rapidly discharged out of the main shaft when the scroll compressor is operated to thereby increase efficiency of pump.

In the conventional scroll compressor, when the lubricating oil sucked through the oil cap 7 flows in the oil feeding passage 23 of the main shaft 6 and flows in the space **6*e* in the eccentric recess 6*d*, the lubricating oil is splashed to the bearing 18 of the orbiting scroll 2 due to the centrifugal force. Especially, when the scroll compressor is used for a refrigerant compressor, the refrigerant is mixed or dissolved in the lubricating oil, whereby foaming and gasification of the refrigerant take place. The gasification of the refrigerant is caused by the two reasons as follows. First, in an oil passage extending from the inlet of the oil feeding passage 23 to the bearing 18, the oil pressure is the lowest at the exit of the oil feeding passage 23 which opens the eccentric recess 6*d*. Second, the temperature of the bearings 18, 19, the temperature of a working fluid subjecting to compression according to the principle of compression which is described above and the temperature of the central part of the base plate 2*b* of the orbiting scroll and the elements located nearby the base plate 2*b* become higher than the other parts. Then, the lubricating oil is heated by these elements having elevated temperatures while it is fed through the space 6*e* in the eccentric recess 6*d* and the bearings 18, 19, 20. When the foamed refrigerant gas is filled in the space 6*e*, or oil grooves formed in the bearings 18, 19, or a space defined by the upper end surface of the main shaft 6, the lower surface of the base plate of the orbiting scroll 2 and the inner circumferential surface of the thrust bearing 20, there takes place difference in pressure between the space 6*e* in the eccentric recess 6*d* and the upper space. For instance, when the pressure of the upper space is higher than that of the space 6*e*** of the eccentric recess, namely, when the oil pressure at the downstream side of the oil feeding passage is higher than that of the upstream side, an oil flow is stopped. Further, since the lubricating oil having foams imparts a large resistance in flow in the oil groove in comparison with the lubricating oil without having the foams, it is difficult to cause a smooth oil flow. Accordingly, there causes locally short of oil supply, whereby the bearings may be damaged, or seizure of the bearings sometimes occurs.

SUMMARY OF THE INVENTION

It is an object of the present invention is to provide a scroll compressor capable of effectively discharging gas filled in the eccentric recess of a main shaft to supply a lubricating oil to bearings in a stable manner.

The foregoing and the other objects of the present invention have been attained by providing a scroll compressor which comprises a stationary scroll having a base plate and a wrap plate projecting from a surface of the base plate, an orbiting scroll having a base plate, a wrap plate projecting from a surface of the base plate and a scroll shaft extending from the other surface thereof, both the wrap plates being combined with each other to form a compression chamber a main shaft provided with an eccentric recess to receive the scroll shaft of the orbiting scroll so as to drive the same through an orbiting scroll bearing, a thrust bearing for supporting the lower surface of the base plate of the orbiting scroll, a bearing supporter means including a main bearing for supporting the main shaft, a first space containing the stationary scroll, the orbiting scroll and the bearing supporter means, an oil feeding passage formed in the main shaft so as to vertically extend from the lower end which opens in a reservoir at the bottom of a shell to the eccentric recess formed at the upper end of the main shaft, a second space formed between the lower surface of the scroll shaft of the orbiting scroll and the bottom surface of the eccentric recess of the main shaft, a third space defined by the upper surface of a large diameter portion of the main shaft, the lower surface of the base plate of the orbiting scroll and the inner circumferential surface of the thrust bearing, an oil groove formed in the orbiting scroll bearing so as to be communicate the second space at the lower part with the third space at the upper part so that oil in the reservoir is lifted by a centrifugal action caused by the revolution of the main shaft to thereby lubricate each bearing parts, wherein a pressure-equalizing passage for communicating the second space with the third space add a gas-vent conduit whose one end is open to the second space and the other end is open to the first space, are formed in the large diameter portion of the main shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
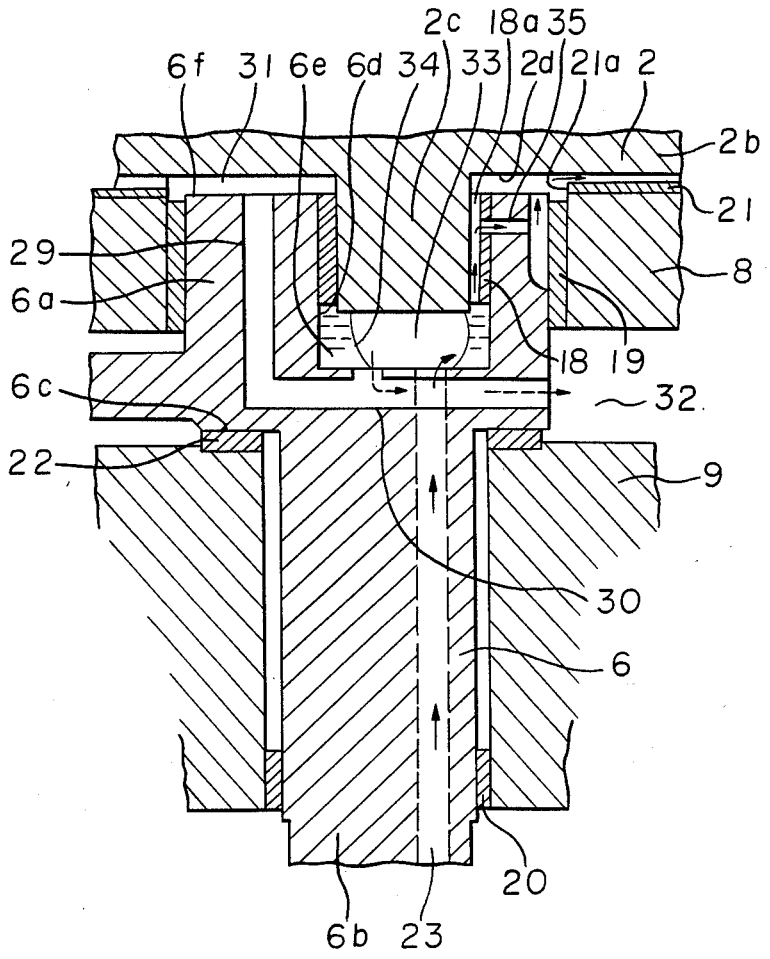
FIG. 1 is a longitudinal cross-sectional view of an embodiment of an important part of the scroll compressor according to the present invention.
Figure 2:
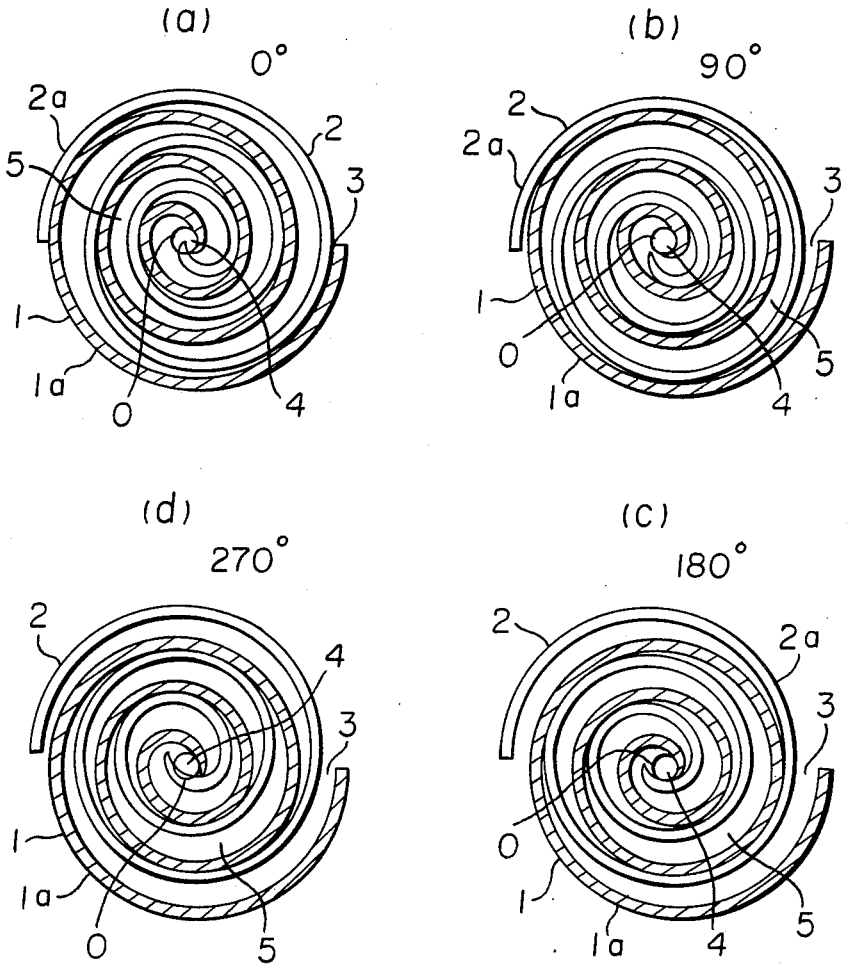
FIG. 2 is a diagram showing the principle of operation of a typical scroll compressor.
Figure 3:
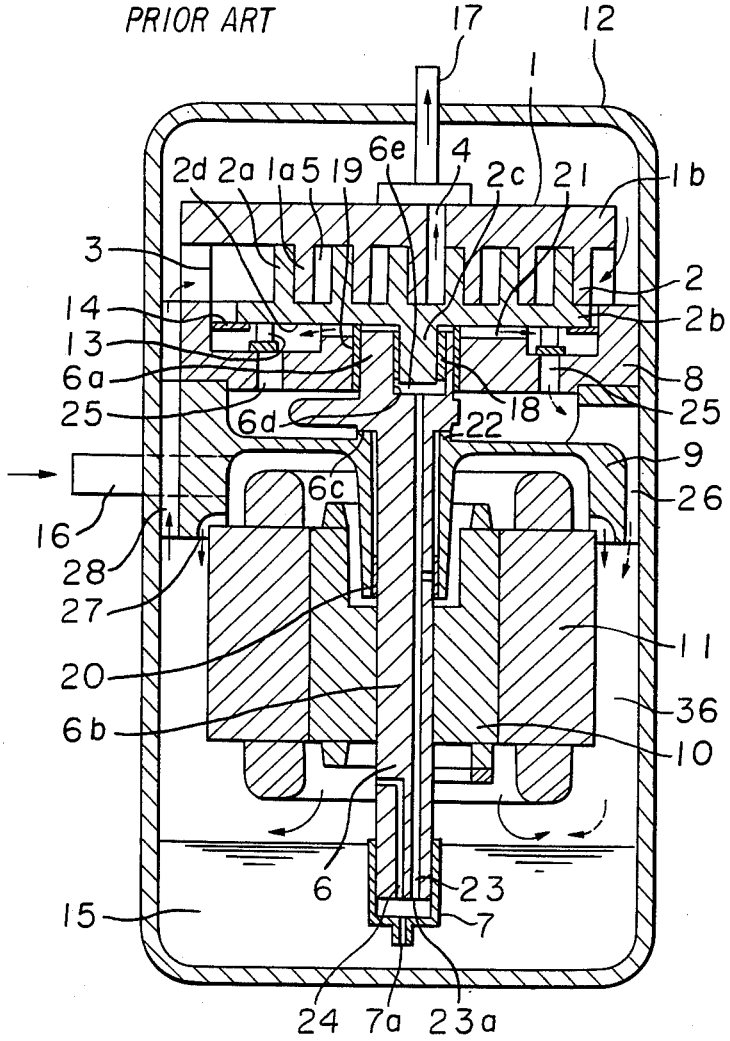
FIGURE 3 PRIOR ART
FIG. 3 is a longitudinal cross-sectional view of a conventional scroll compressor.

Referring now to the drawings, wherein like reference numerals designate the same or corresponding parts in the drawings, and more particularly to FIG. 1 thereof, there is shown a longitudinal cross-sectional view of a typical example of the scroll compressor according to the present invention. A pressure-equalizing passage 29 is formed in the large diameter portion 6*a* of the main shaft 6. An opening of the pressure-equalizing passage 29 opens to a second space 6*e* in the eccentric recess 6*d* an the other opening opens at a third space 31 which is defined by the upper end surface 6*f* of the main shaft 6, the lower surface of the base plate 2*b* of the orbiting scroll 2 and the inner circumferential surface 21*a* of the thrust bearing 21 for supporting the lower surface of the base plate 2*b*. More specifically, the pressure-equalizing passage 29 extends vertically in the large diameter part 6*a* of the main shaft and is vent in the radial direction, and opens in the bottom surface of the eccentric recess 6*d* at or near its central part. A gas-vent conduit 30 communicates a first space 32 which acts as a pressure balancing chamber surrounded by the bearings supporters 8, 9 in the shell 12 with the second space 6*e*. More specifically, an end of the gas-vent conduit 30 is directly connected to the lower part of he opening of the pressure-equalizing passage 29 and the other end opens at the outer circumferential surface of the large diameter portion 6*a* of the main shaft 6. Pressure in the pressure-balancing chamber 32 is equal to pressure inside of the shell 12 by means of the oil returning opening 26. The gas-vent conduit 30 may be formed independently without direct communication with the pressure-equalizing passage 29. In FIG. 1, a reference numeral 34 designates a border line between a gas phase and a liquid phase in the second space 6*e* and indicates an outline of a gas region.

The operation of the scroll compressor having the above-mentioned construction will be described. The lubricating oil is sucked through the oil cap 7 and is fed in the oil feeding passage 23 by a centrifugal pumping action. Then, the oil supplied in the eccentric recess 6*d* is accelerated toward the inner circumferential wall of the recess 6*d* and is splashed to the bearing 18. A part of the oil is passed through a groove 18*a* formed in the bearing 18 so that it is supplied to the bearings 19, 21 by the centrifugal force through a slit 35. The slit 35 is formed in the large diameter portion 6*a* so as to communicate the groove 18*a* with the outer circumference of the large diameter portion 6*a*.

Generally, oil pressure in the space of the eccentric recess 6*d*, i.e. the second space 6*e* is lower than that of the first space 32 because the lubricating oil in the groove 18*a* is fed by the centrifugal force. Namely, a negative pressure easily takes place in that portion. Further, during the operation of the scroll compressor, the temperature of the base plate 2*b* of the orbiting scroll 2 at its central or the circumferential portion become higher than the temperature of the other elements due to heat generated from the bearings 18, 19 and the working fluid, with the consequence that in the second space and the bearing groove 18*a*, there results in generation of foam of a refrigerant (such as Freon R12, R22) which is dissolved in the lubricating oil. If such a state occurs, pressure in the third space becomes higher than that in the second space, and resistance in a flow path for flowing the foamed fluid becomes large, so that it is difficult to supply the lubricating oil. As a result, there arises a shortage of the oil to the bearing 18 and the seizure or fault may occur.

On the other hand, in the present invention, the pressure-equalizing passage 29 and the gas-vent conduit 30 are formed to equalize pressure in each of the first to third spaces, whereby an excessive amount of gas is discharged to the balancing chamber 32 even though generation of foam of the gas occurs in the second and third spaces due to sudden reduction in pressure and temperature rise during the operation of the scroll compressor; thus a constant amount of gas is kept in each of the spaces. Thus, with a gas discharging means consisting of the space of the eccentric recess 6*d* as the second space 6*e*, the third space 31, the gas-vent conduit 30, the balancing chamber 32 as the first space and the space in the shell 12, the foamed refrigerant gas in the second space 6*e* and the third space 31 can be smoothly discharged in the space of the shell 12.

In FIG. 1, the solid arrow marks indicate oil flows and the broken arrow marks indicate the foamed gas flow.

As described above, in accordance with the present invention, the gas-vent conduit is formed in the large diameter portion of the main shaft to communicate the eccentric recess with tee space of the shell, whereby the foamed refrigerant gas in the second space can be rapidly discharged to the space of the shell as the first space. Further, the pressure-equalizing passage is formed in the large diameter portion of the main shaft to communicate the eccentric recess as the second space with the third space which is formed between the upper end surface of the main shaft and the lower surface of the base plate of the orbiting scroll, whereby the oil including the foamed refrigerant gas can be smoothly passed through the bearings, and a suitable difference in pressure between the second and third spaces can be provided to smoothly supply the oil. Accordingly, the lubricating oil is stably supplied to the bearings and the fault such as seizure of the bearings can be prevented.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll compressor which comprises:

a stationary scroll having a base plate and a wrap plate projecting from surface of said base plate;

an orbiting scroll having a base plate, a wrap plate projecting from a surface of said base plate and a scroll shaft extending from the other surface thereof, both the wrap plates being combined with each other to form a compression chamber;

a main shaft provided with an eccentric recess to receive said scroll shaft of the orbiting scroll so as to drive the same through an orbiting scroll bearing;

a thrust bearing for supporting the lower surface of said base plate of the orbiting scroll;

a bearing supporter means including a main bearing for supporting said main shaft;

a first space containing said stationary scroll, said orbiting scroll and said bearing supporter means;

an oil feeding passage formed in said main shaft so as to vertically extend from the lower end thereof which opens in a reservoir at the bottom of a shell to said eccentric recess formed at the upper end of the main shaft, a second space formed between the lower surface of said scroll shaft of the orbiting scroll and the bottom surface of said eccentric recess of the main shaft;

a third space defined by the upper surface of a large diameter portion of the main shaft, the lower surface of the base plate of said orbiting scroll and the inner circumferential surface of said trust bearing;

an oil groove formed in said orbiting scroll bearing so as to communicate said second space at the lower part with said third space at the upper part so that oil in said reservoir is lifted by a centrifugal action caused by the revolution of said main shaft to thereby lubricate said bearing parts, wherein a pressure-equalizing passage for communicating said second space with said third space and a gas-vent conduit whose one end is open to said second space and the other end is open to said first space, are formed in the large diameter portion of said main shaft.

2. The scroll compressor according to claim 1, wherein one of the openings of said pressure-equalizing passage is open at the bottom of said eccentric recess.

3. The scroll compressor according to claim 2, wherein said opening is at or near the center of the bottom of said eccentric recess.

4. The scroll compressor according to claim 2, wherein said gas-vent conduit is communicated with said pressure-equalizing passage at the lower part of said one of the openings.

5. The scroll compressor according to claim 1, wherein the opening of said gas-vent conduit is open to the outer circumferential surface of the large diameter portion of said main shaft.

6. The scroll compresor according to claim 1, wherein an opening of said pressure equalizing passage is open to the upper surface of the large diameter portion of said main shaft.

* * * * *